US006802635B2

(12) United States Patent
Robertson et al.

(10) Patent No.: US 6,802,635 B2
(45) Date of Patent: Oct. 12, 2004

(54) ILLUMINATED TRANSLUCENT DEVICES

(75) Inventors: Jonas J. Robertson, Harvey, LA (US); Robert M. Currie, Long Beach, MS (US); Problems Y. Currie, Long Beach, MS (US); Joseph E. Currie, Webster, NH (US)

(73) Assignee: Plastic Inventions & Patents, Inc.

( * ) Notice: Subject to any disclaimer, the term of this patent is extended or adjusted under 35 U.S.C. 154(b) by 91 days.

(21) Appl. No.: 10/235,536

(22) Filed: Sep. 6, 2002

(65) Prior Publication Data

US 2003/0133311 A1 Jul. 17, 2003

Related U.S. Application Data

(60) Provisional application No. 60/348,994, filed on Jan. 17, 2002, provisional application No. 60/349,328, filed on Jan. 18, 2002, and provisional application No. 60/361,852, filed on Mar. 6, 2002.

(51) Int. Cl.[7] ..... F21V 7/04

(52) U.S. Cl. ..... 362/555; 362/414; 362/565; 362/576; 362/583

(58) Field of Search ..... 362/27, 219, 238, 362/410, 412, 414, 511, 551, 555, 565, 576, 583

(56) References Cited

U.S. PATENT DOCUMENTS 3,532,874 A 10/1970 Rosenast
4,408,260 A * 10/1983 Miedel ..... 362/576
4,513,692 A 4/1985 Kuhnsman et al.
5,016,973 A 5/1991 Hager et al.
5,060,119 A 10/1991 Parthasarathy
5,067,060 A * 11/1991 Sieracki ..... 362/414
5,495,400 A 2/1996 Currie
5,701,236 A * 12/1997 Viviano ..... 362/576
6,173,517 B1 1/2001 Eibner et al.

* cited by examiner

*Primary Examiner*—Stephen F. Husar
(74) *Attorney, Agent, or Firm*—Merek, Blackmon & Voorhees

(57) ABSTRACT

A series of different embodiments of illuminated translucent devices, each include lighting at at least one end thereof and a channel or passage therethrough or therealong for installing connecting electrical wiring therein. An opaque sleeve or the like is provided about the passage to conceal the passage and any wiring or other element(s) installed therein. The lighting elements may be any suitable type, but LEDs are preferred. The external cross sectional shape of the device may be round, or any other shape as desired for use as a free standing column or support, or as a wall mounted sconce or the like. Some embodiments include a structural member therein or opaque structural sleeve therearound, with the outer sleeve having a series of light passages formed therethrough. The devices may be used as floor lamp or ceiling fan columns, guard or bannister rails, vehicle guards and racks, etc., as desired.

20 Claims, 16 Drawing Sheets

ILLUMINATED TRANSLUCENT DEVICES

REFERENCE TO RELATED PATENT APPLICATION

This application claims the benefit of U.S. Provisional Patent Applications Ser. No. 60/348,994, filed on Jan. 17, 2002; Ser. No. 60/349,328, filed on Jan. 18, 2002; and Ser. No. 60/361,852, filed on Mar. 6, 2002.

BACKGROUND OF THE INVENTION

1. Field of the Invention

The present invention relates generally to translucent or transparent devices having illumination sources therewith. More particularly, the present invention comprises a series of different embodiments of an elongate, translucent element having an electrical conductor passage or channel therethrough or therein, with electrically powered lighting means illuminating the translucent element from one or both ends thereof. Various means are provided for concealing the wiring within the elongate element, as well as other variations upon the present invention.

2. Description of the Related Art

Innumerable elongate tubular and cylindrical rod supports, columns, stands, rails, bannisters, etc., are conventionally used in a multitude of widely varying devices and structures. Examples of such are poles or columns for floor lamps; columns for suspending ceiling fans and ceiling mounted lights therefrom; tubular bumper and grille guard structures in motor vehicles, particularly for pickup trucks and sport utility vehicles; roof racks, laterally mounted steps, and the like for such vehicles; and bridge, highway, and other guardrails, bannisters, and balusters. While the above list is relatively comprehensive, it should be understood that it is not all-inclusive, and that many other elongate structural elements are known.

A universal characteristic of such elongate elements, is their lack of internal or integral lighting therewith. This is an important consideration, widely recognized by traffic engineers. It is common for such structures to be illuminated by reflective or phosphorescent tape, paint, or other means when used in the highway or roadway environment, and/or to provide external flood or spot lighting of such structures to alert motorists as to their location and proximity. Also, motor vehicles themselves are universally fitted with various lighting elements, particularly larger trucks with their side mounted clearance lighting. However, where other structural assemblies are provided, e.g., bumper and grill guards, rollover structures and roof racks, etc., they are universally lighted with only reflective elements, if at all.

In addition, there are innumerable elongate rails, guards, bannisters, columns, etc. which are normally a part of the interior architecture and/or structure of many, if not most, building structures, both in the home and in commercial establishments. Typically, these structures are not directly illuminated from within, but where any illumination is provided at all, it is from some secondary, supplementary light source, and/or reflective or phosphorescent coatings (paint, tape, etc). The need for high visibility for such structures is well known, as evidenced by the widespread use of reflective tape and the like upon such structures, as well as along the edges of stairway treads and the like in relatively poorly lighted areas. Still other structures, e.g., lamp poles, ceiling fan supports, etc., could benefit from the attractive appearance which may be provided by means of an illuminated translucent structure, but little, if anything, has been done in this field.

A universal characteristic of such structures and devices is their lack of integral illumination to provide internal lighting from the device or structure itself, as noted above. Heretofore, when the need for illuminating such structures was perceived, all lighting has been accomplished by means of additional external, supplementary lighting directed at the structure or device, and/or the application of reflective or phosphorescent coatings of some sort to the structure or device.

Accordingly, a need will be seen for illuminated translucent structures and devices, comprising an elongate translucent or transparent member having a passage or channel formed therein or therealong for placement of an electrical conductor therein. The electrical conductor channel is preferably concealed by some means, such as reflective material surrounding the channel, or an opaque structural member installed within the channel or within the body of the translucent member, in order to conceal the electrical wiring therein. The exterior of the translucent member may be covered by a generally solid structural tubular member for greater structural strength, with the tubular member having one or more light passages formed therethrough to produce a patterned light emission from the translucent element carried therein. Such translucent elements having surrounding solid tubular structures with light passages formed therein, serve well as structural guard rails, bannisters, bumper and grill guards, etc.

All of the above described devices are easily illuminated by means of light emitting diodes (hereinafter known as "LEDs" throughout the remainder of the disclosure), or other lighting means, as desired. The provision of electrical conductors extending through or along the translucent member, enables LEDs or other lighting means to be installed at various points along the assembly, to maintain illumination along the entire assembly.

A discussion of the related art of which the present inventors are aware, and its differences and distinctions from the present invention, is provided below.

U.S. Pat. No. 3,532,874 issued on Oct. 6, 1970 to Robert S. Rosenast, titled "Decorative Structure," describes a device having a series of concentric, telescoping tubes formed of clear or opaque plastic material, with a series of flexible fiberoptic strands disposed between each concentric pair of tubes. The outer tubes are shorter than the inner tubes, with the flexible fiberoptic strands extending from the space between the end of each outer tube and the upstanding wall of the next innermost tube, in a spreading array. Rosenast provides active lighting for his decorative assembly from only one end thereof, and does not disclose any form of a passage through or along the structural members of the device for the installation of electrical wiring therein, nor does he provide any lighting means at the opposite end of the assembly from the single active lighting source disclosed.

U.S. Pat. No. 4,513,692 issued on Apr. 30, 1985 to Alexandra Kuhnsman et al., titled "Illuminatable Pet Leash," describes a flexible leash device having an external transparent plastic tube formed of Tygon® plastic material, with a series of fiberoptic strands contained therein. Kuhnsman et al. provide a light source at the handle end of the leash, which shines axially along the fiberoptic strands. However, no rigid structure, electrical wiring and passage therefor, nor illumination at opposite ends of the elongate device (or portion thereof), is provided by Kuhnsman et al., as is provided by the present invention in its various embodiments.

U.S. Pat. No. 5,016,973 issued on May 21, 1991 to Thomas P. Hager et al., titled "Cable Reinforcement For An Optical Fiber Cable," describes a glass fiberoptic strand surrounded by a yarn having a glass fiber weave therein. The assembly is then covered with a polyethylene sleeve and heated to fuse the synthetic yarn fibers with the outer polyethylene sleeve. The result is a relatively stiff fiberoptic cable structure which protects the inner glass fiberoptic strand due to the glass fibers fused with the outer sleeve during the heating process. Hager et al. do not disclose any form of lighting for their cable, and particularly do not provide any means for transmitting electrical power through their cable to provide active illumination at both cable ends, or section thereof. The present invention includes such electrical conductor channel means therein, and comprises a rigid structure which provides side lighting, unlike the Hager et al. cable.

U.S. Pat. No. 5,060,119 issued on Oct. 22, 1991 to Mellapalayam R. Parthasarathy, titled "Light Pipe For Decorative Illumination," describes a series of embodiments, each incorporating internal and external components having different indices of refraction. The two components are tapered to have a conical shape, resulting in light scattering along the length of the light pipes as the light progresses toward the narrower end of the internal component. While Parthasarathy discloses a central structural member in one embodiment, he does not disclose any conduit passage through his solid core light pipes, and his tapered structure teaches away from lighting the device from both ends.

U.S. Pat. No. 5,495,400 issued on Feb. 27, 1996 to Joseph E. Currie, titled "Optical Fiber Illumination Device," describes a series of embodiments of an optical fiber lighting system for use with motor vehicles. The device may be used as supplemental illumination for such vehicles, in the manner of side marker lights on the sides of pickup truck boxes and the like. Means are disclosed for activating and deactivating the lighting in concert with operation of parking lights, brake lights, turn signals, and other vehicle lighting, as desired. While Currie discloses a slotted opaque structure enclosing the fiberoptic lighting device therein, he does not provide any means of conducting electrical power through the fiberoptic device for energizing light sources at opposite ends of the device, as provided by the present invention.

Finally, U.S. Pat. No. 6,173,517 issued on Jan. 16, 2001 to Wolfgang Eibner et al., titled "Luminous Display Element With A Light Coupled Into A Light Conducting Housing," describes a series of embodiments of a translucent light assembly having a light emitting element (surface mounted LED array) therein. Eibner et al. teach away from the present invention due to the lighting element(s) being installed within the translucent member of the device. The present invention does not include any lighting elements therein, but rather provides a channel or guide for an electrical conductor (s) running through the translucent member, in order to provide electrical power for lighting units at opposite ends of the device, and/or at joints therealong.

None of the above inventions and patents, taken either singularly or in combination, is seen to describe the instant invention as claimed. Thus illuminated translucent devices solving the aforementioned problems are desired.

SUMMARY OF THE INVENTION

The present invention comprises a number of different embodiments of an illuminated translucent device, having an elongate translucent body which is illuminated at each end (and/or at some intermediate location) thereof. A first end may include a first lighting element therewith, oriented to direct light into the end of the translucent body, and at least one distal second lighting element at the opposite end of the translucent member. The translucent member includes a passage or channel formed therethrough or therealong, for an electrical conductor(s) for providing power to the distal second lighting element at the opposite end or location removed from the first lighting element.

Preferably, the passage for the electrical conductor(s) is concealed by providing some form of reflective coating surrounding the internal passage or external channel, rendering the area immediately around the passage or channel, opaque. A tubular structural member (e.g., steel tube, etc.) may be installed within a central channel, providing additional structural strength as well as concealing any wiring elements extending through the channel. Alternatively, the translucent material itself may be treated to produce an effect which conceals the inner structure thereof.

The present invention may also be combined with a solid, opaque tubular member installed thereover, to provide the desired structural strength for use in guard rails, vehicle bumper and grille guards and other similar structures, etc. The opaque external member includes at least one light passage formed through the wall thereof, allowing light to escape from the translucent member therein to illuminate the structure. Different colored lighting, including control by timer or other means, may be applied to any of the embodiments of the present invention as desired.

Accordingly, it is a principal object of the invention to provide various embodiments of illuminated translucent devices, each including an elongate translucent member having first lighting means at a first end thereof, at least secondary lighting means at a distal location therein or at a distal second end thereof, a channel formed therein for an electrical conductor(s) for energizing the distal secondary lighting means, and means for concealing the channel.

It is another object of the invention to provide such illuminated translucent devices incorporating various lighting principles, but most preferably incorporating LED lighting means therewith, with the LED lights directed into opposite ends of the translucent member.

It is a further object of the invention to provide an opaque structural member surrounding the central translucent element, with the opaque structural member having at least one light passage formed through the wall thereof.

Still another object of the invention is to provide additional options for the present invention, including installation of a hollow structural tube within or surrounding the passage through the illuminated member, concentric illuminated members having lighting passages formed therethrough, and colored lighting.

It is an object of the invention to provide improved elements and arrangements thereof for the purposes described which is inexpensive, dependable and fully effective in accomplishing its intended purposes.

These and other objects of the present invention will become apparent upon review of the following specification and drawings.

Figure 3:
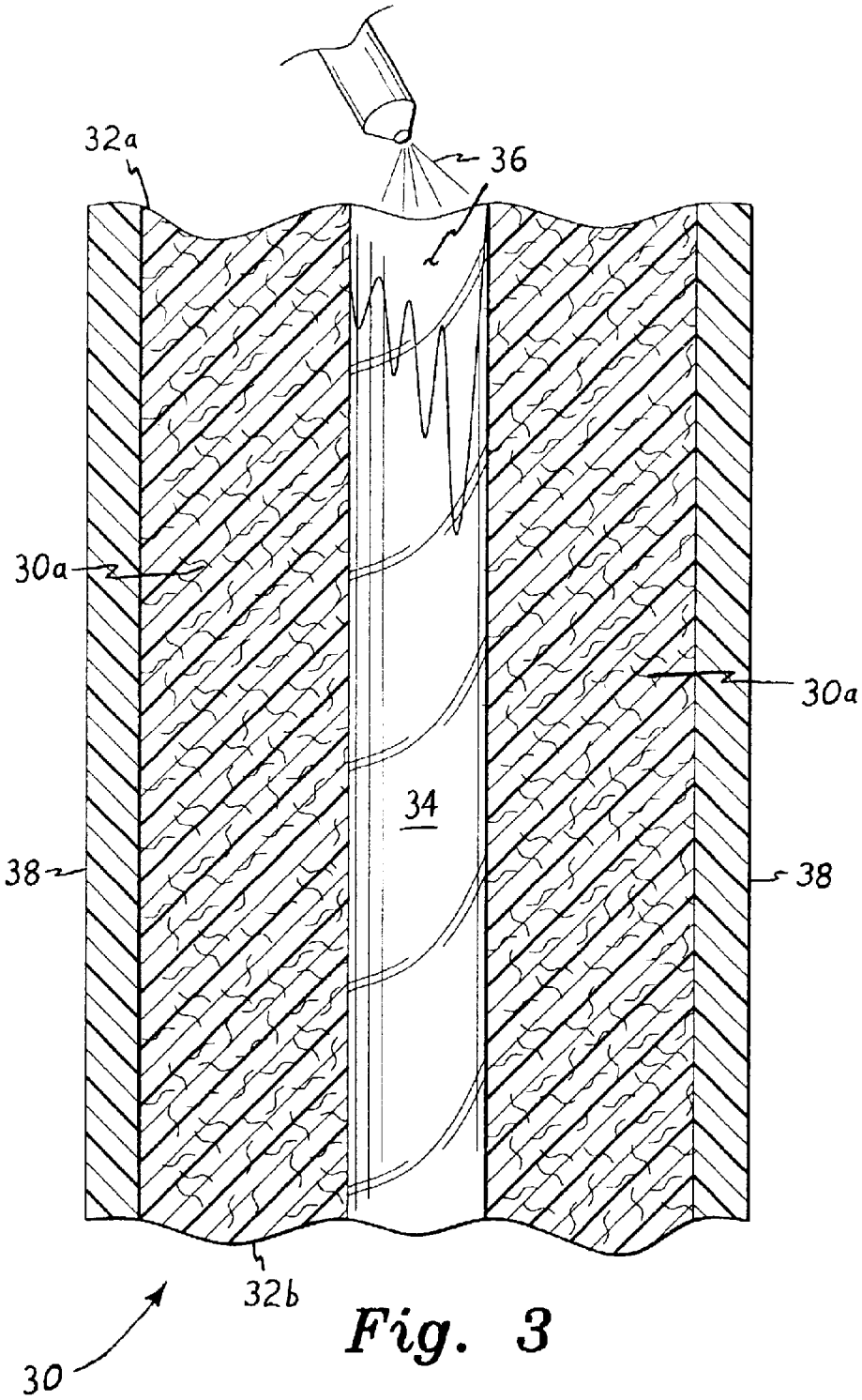

FIG. 3 is a side elevation view in section, showing a means for crazing the internal structure of the translucent element for concealing the internal passage therethrough.

Figure 4:
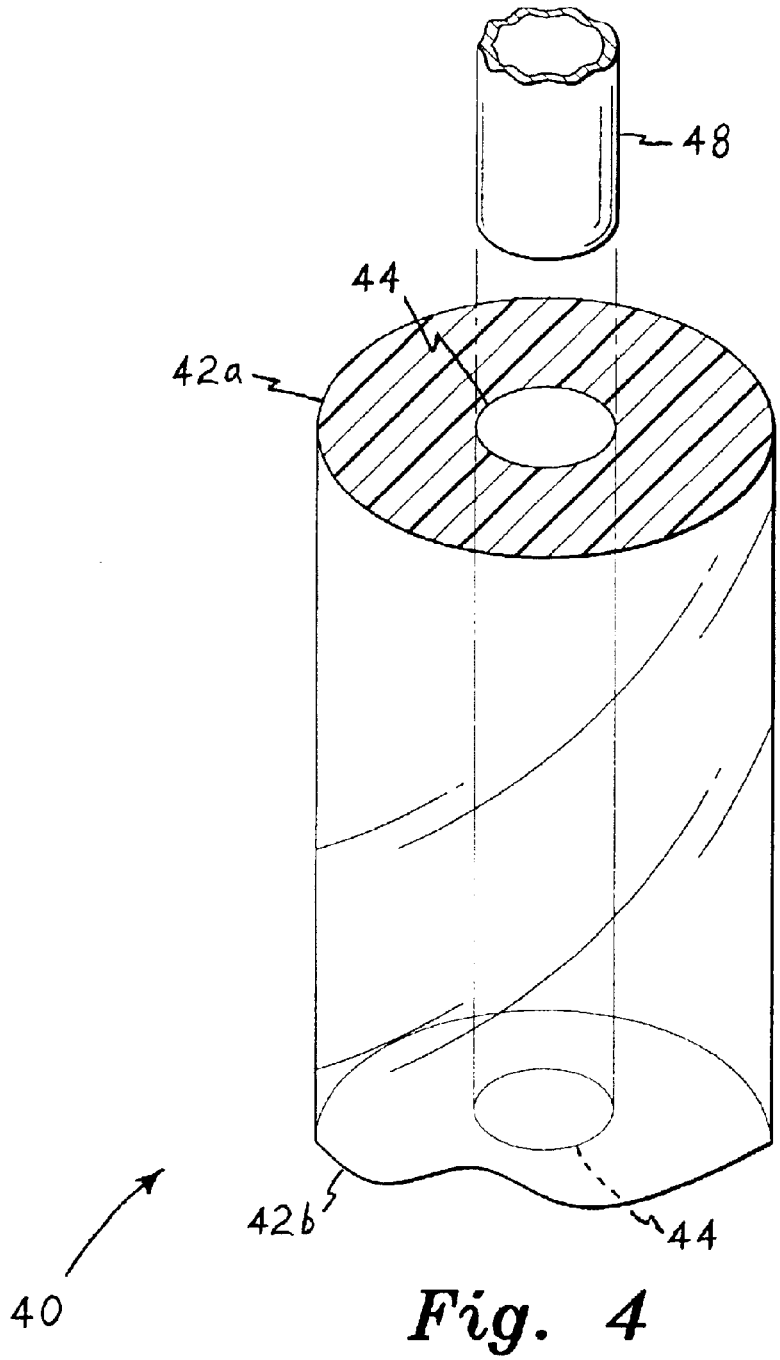

FIG. 4 is an exploded perspective view of a fourth embodiment of the present invention, showing the insertion of an opaque structural tube into the central passage of the translucent member.

Figure 5:
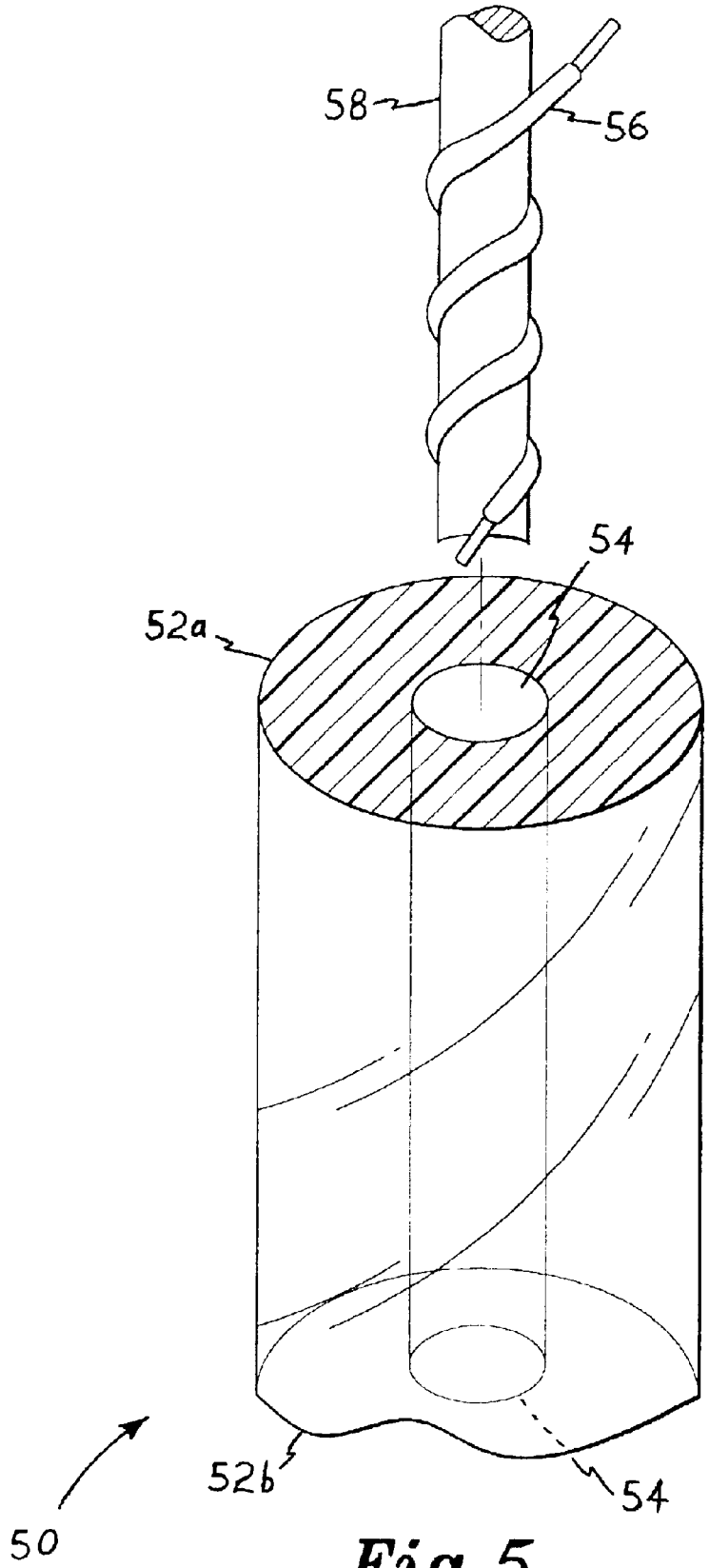

FIG. 5 is an exploded perspective view of a fifth embodiment of the present invention, showing the insertion of a solid support rod and electrical conductor through the central passage of the translucent member.

Figure 6:
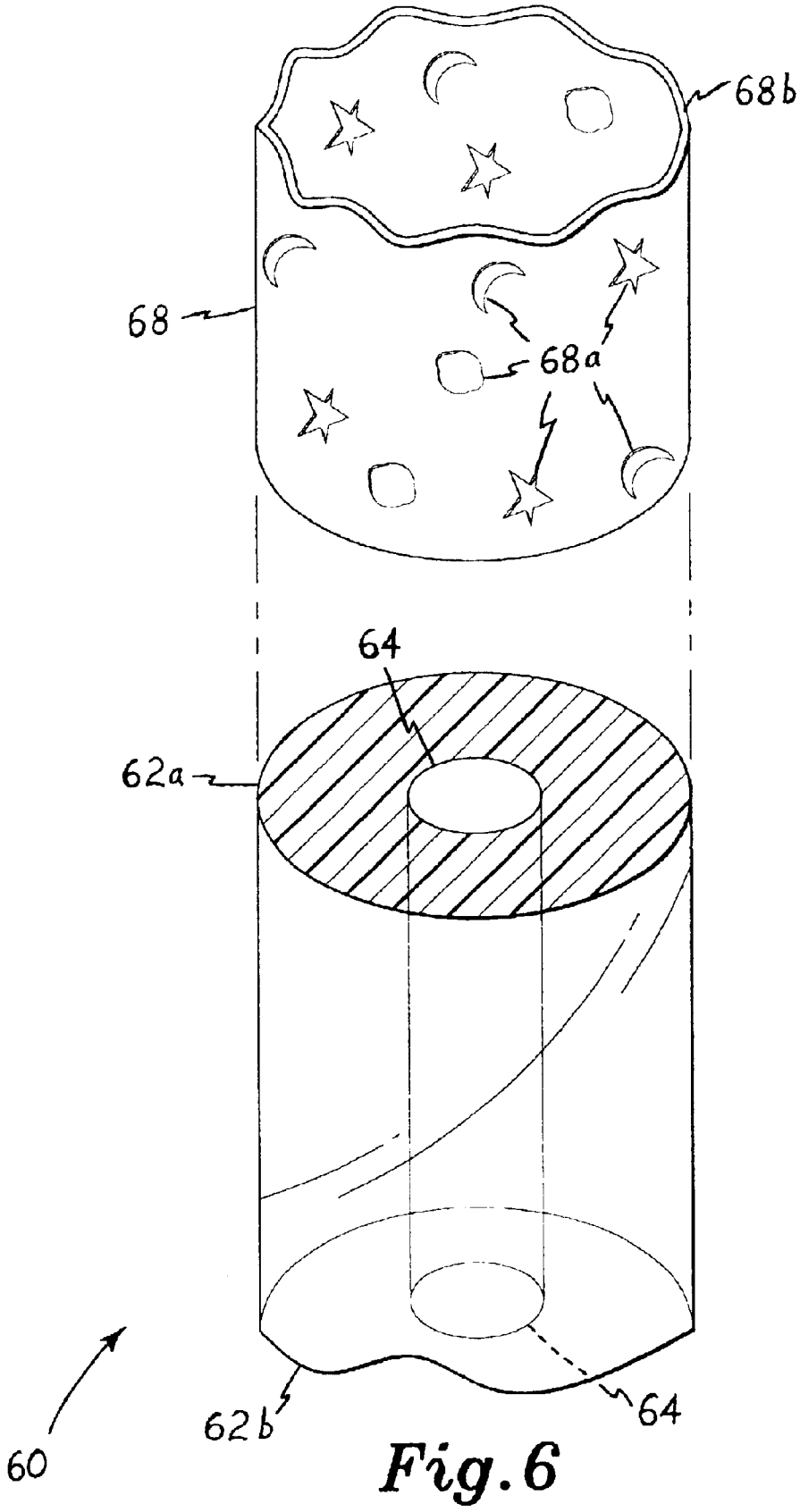

FIG. 6 is an exploded perspective view of a sixth embodiment of the present invention, showing the installation of an opaque structural member having light passages therethrough, over the translucent member.

Figure 7:
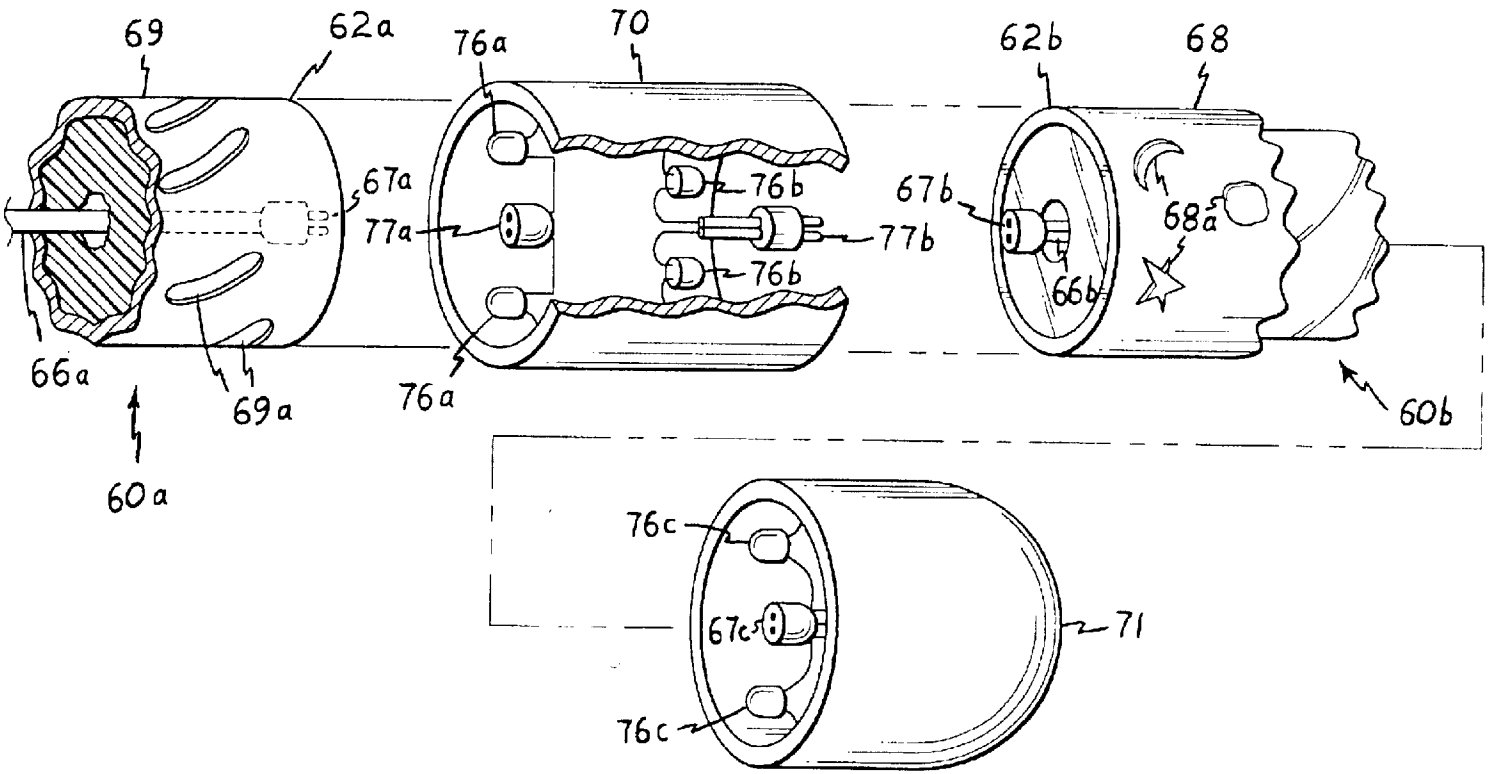

FIG. 7 is an exploded perspective view of a seventh embodiment of the present invention, showing provision for end connectors and caps for joining multiple lengths of the assemblies of FIG. 6.

Figure 8:
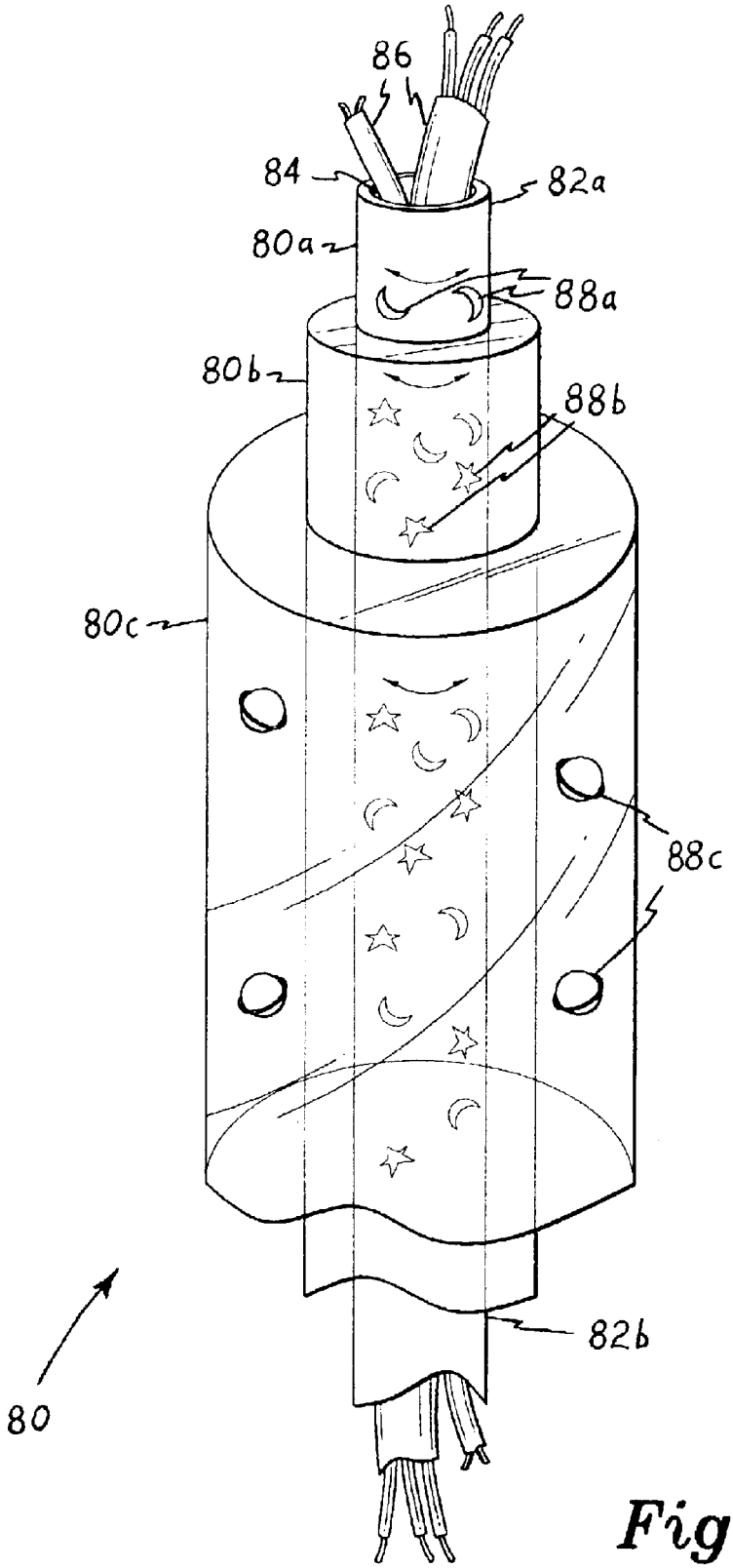

FIG. 8 is a perspective view of an eighth embodiment of the present invention, comprising a series of concentric translucent members which may rotate relative to one another.

Figure 9:
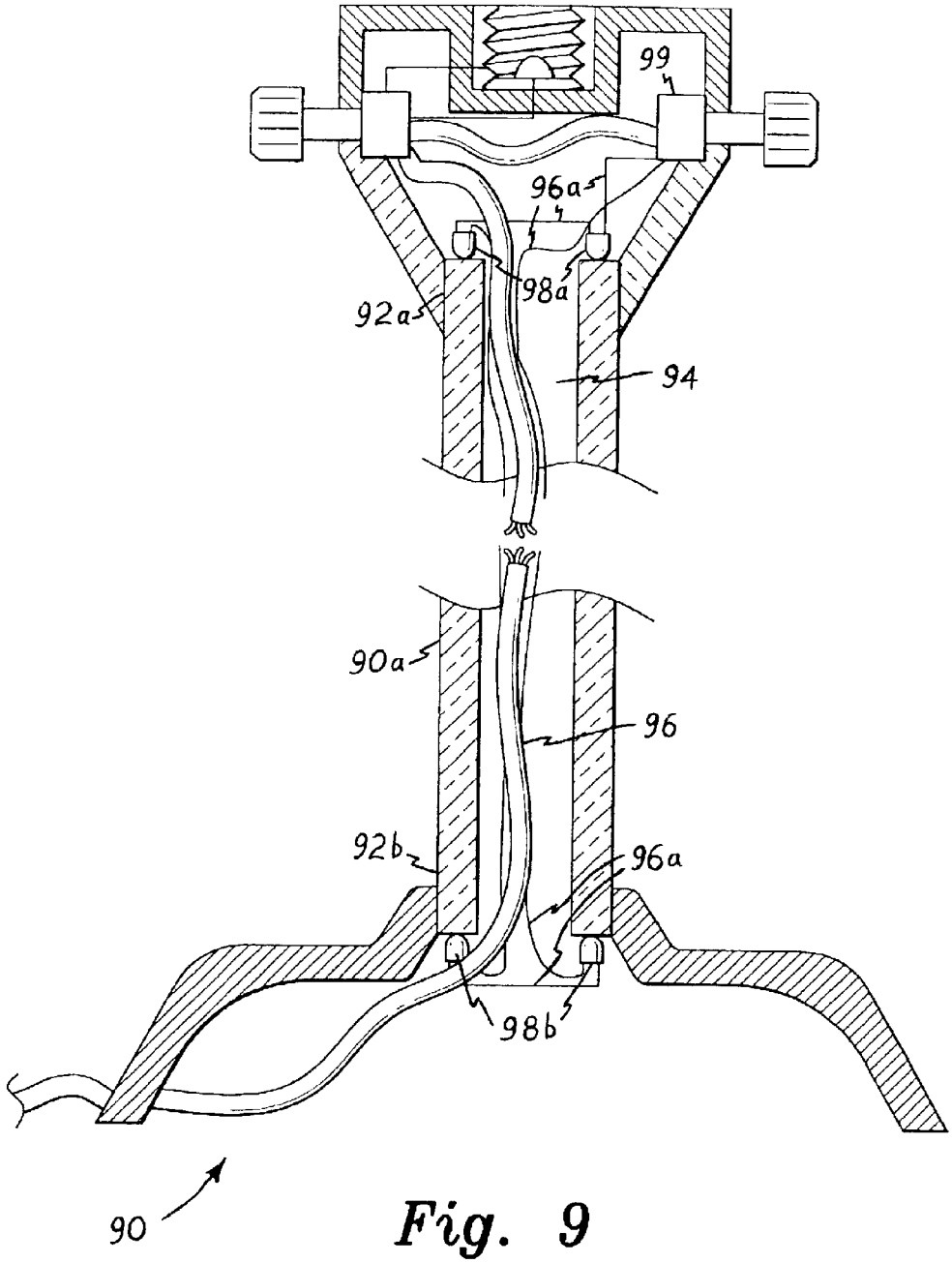

FIG. 9 is an elevation view in section showing details of a floor lamp incorporating the translucent illuminated member of the present invention.

Figure 10:
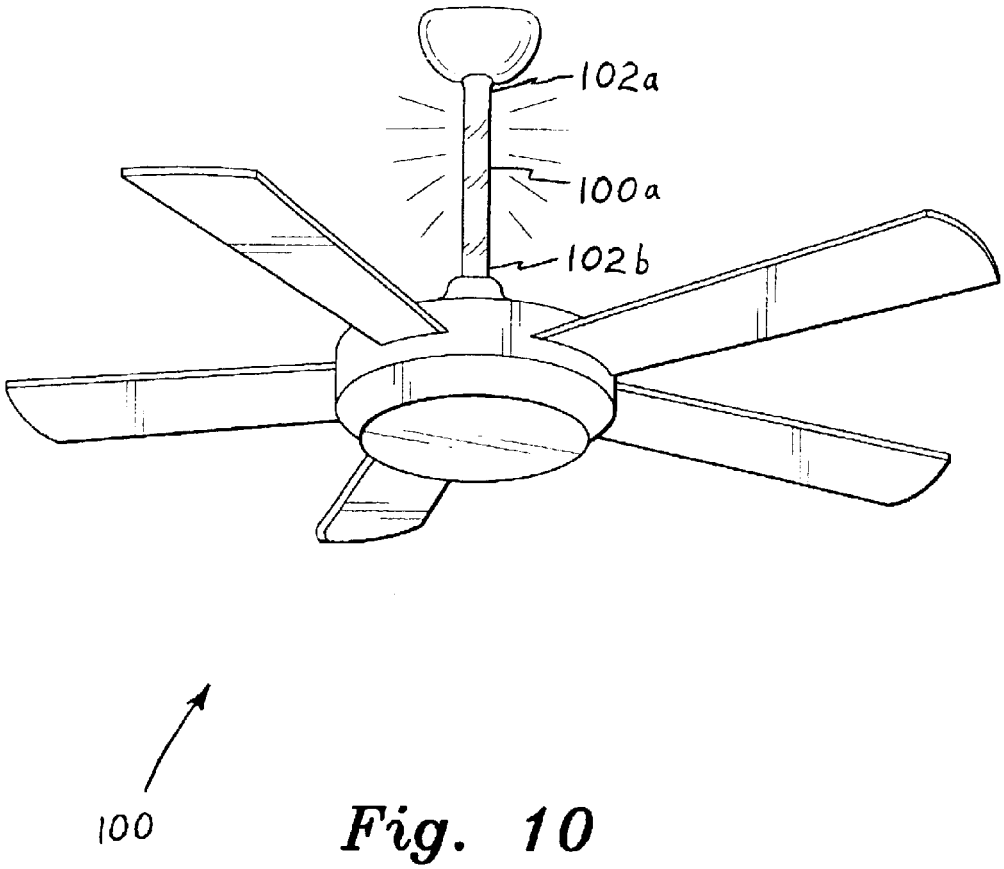

FIG. 10 is a perspective view of a ceiling fan incorporating the translucent illuminated member of the present invention.

Figure 11:
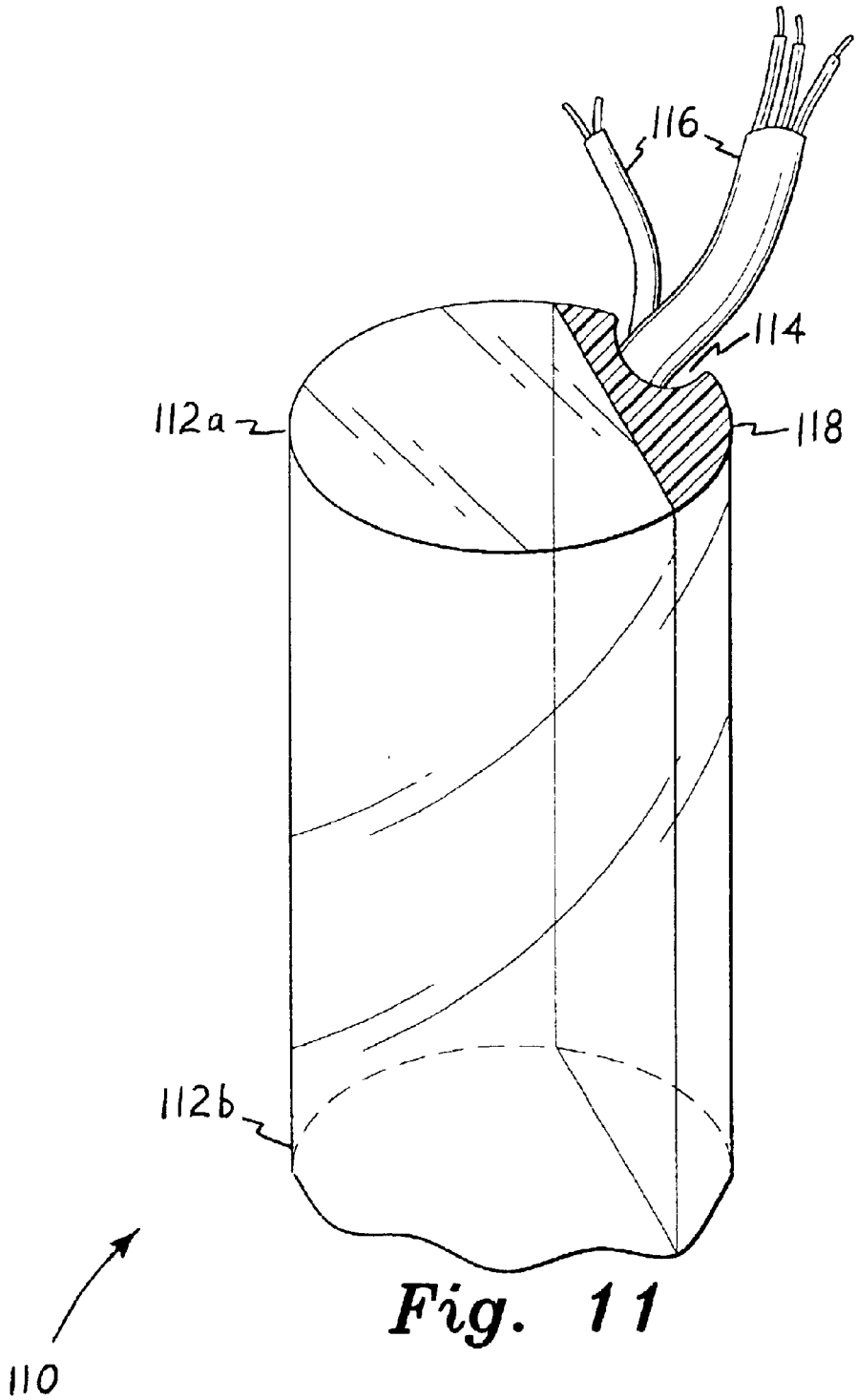

FIG. 11 is a perspective view of a ninth embodiment of the present invention, showing a translucent member having a conduit channel formed in an opaque portion thereof, concealing the channel.

Figure 12:
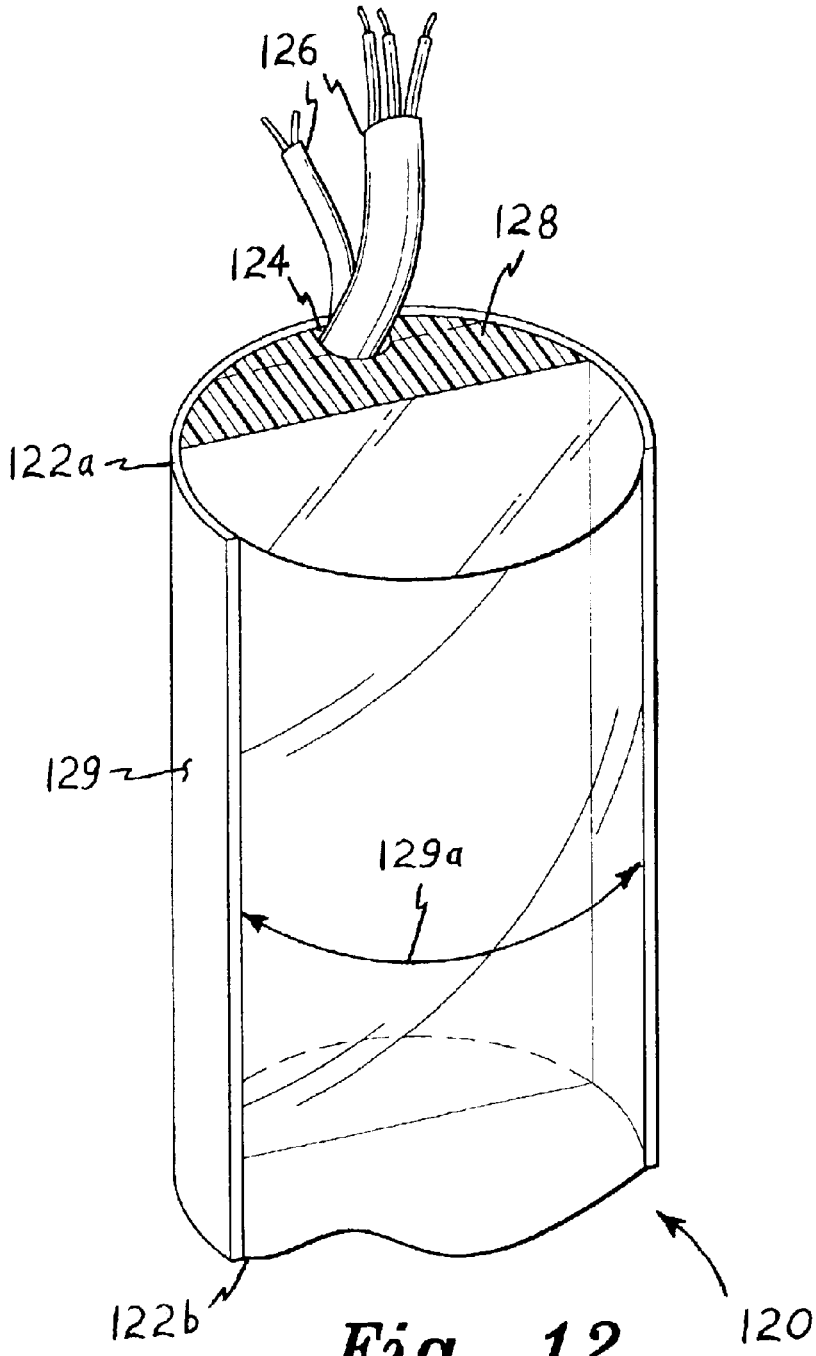

FIG. 12 is a perspective view of a tenth embodiment of the present invention, showing an assembly similar to that of FIG. 11 but including a semicylindrical retainer over the channel.

Figure 13:
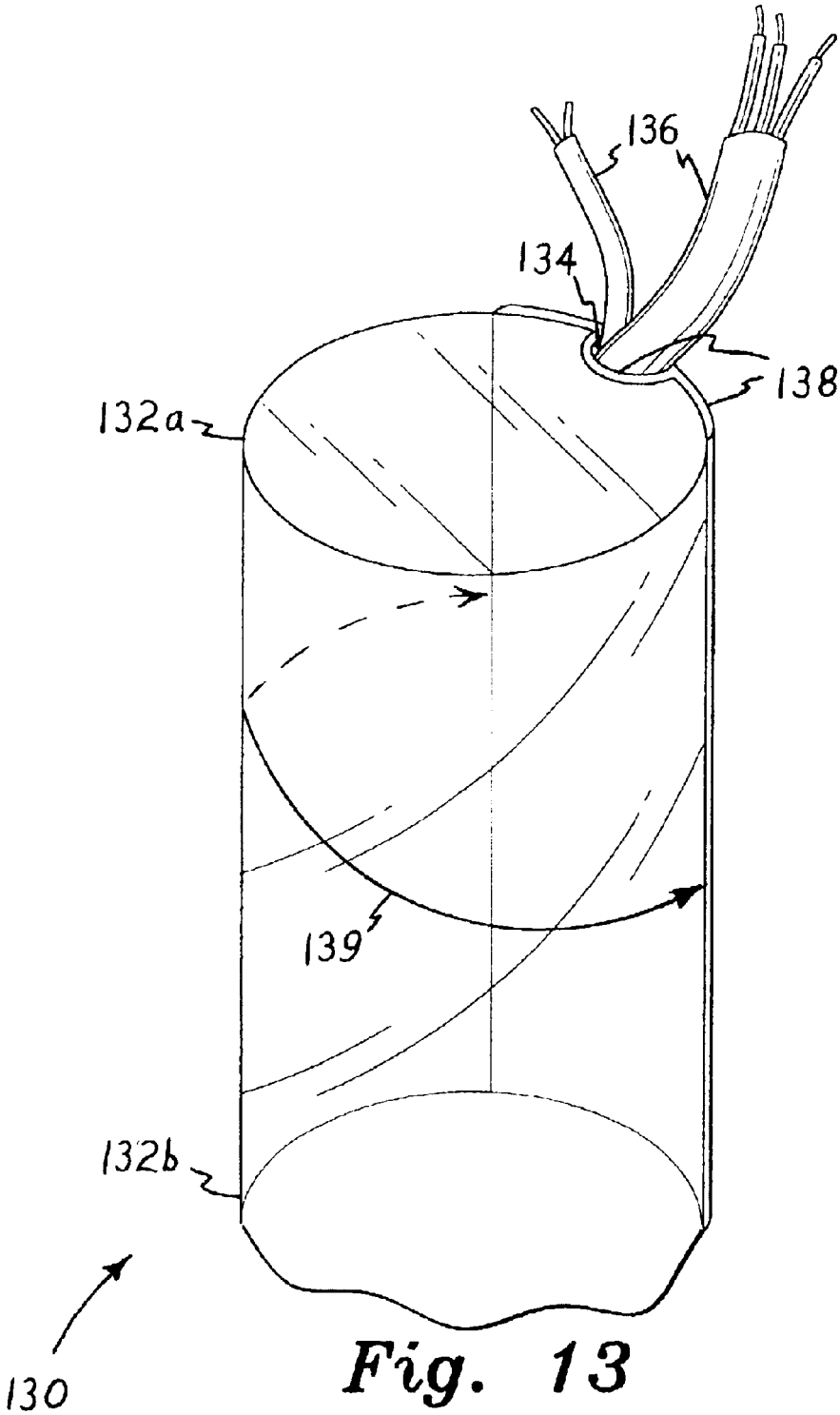

FIG. 13 is a perspective view of an eleventh embodiment of the present invention, showing an opaque, reflective coating applied between the channel and the translucent member.

Figure 14:
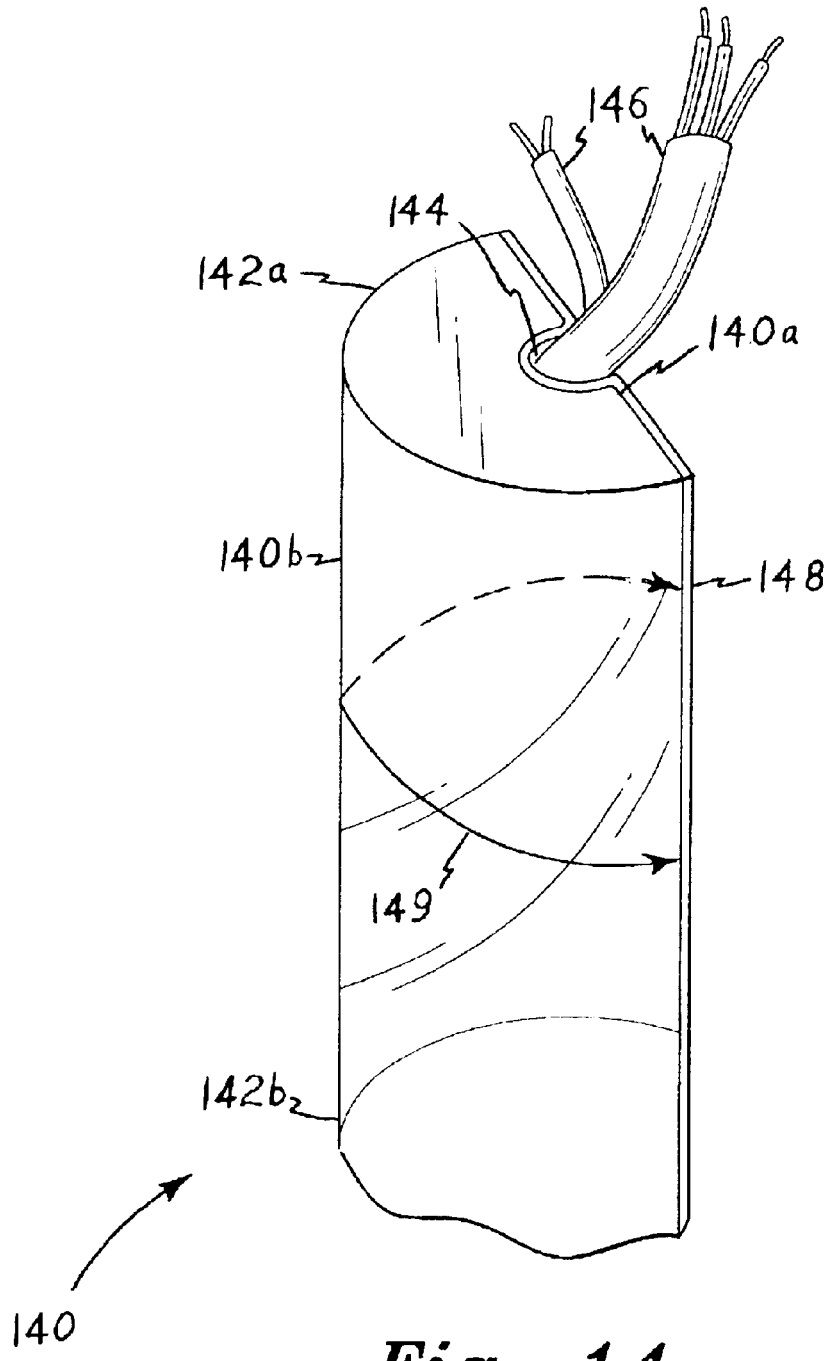

FIG. 14 is a perspective view of a twelfth embodiment of the present invention, showing a semicylindrical translucent member with an opaque reflective coating between the channel and translucent member.

Figure 15:
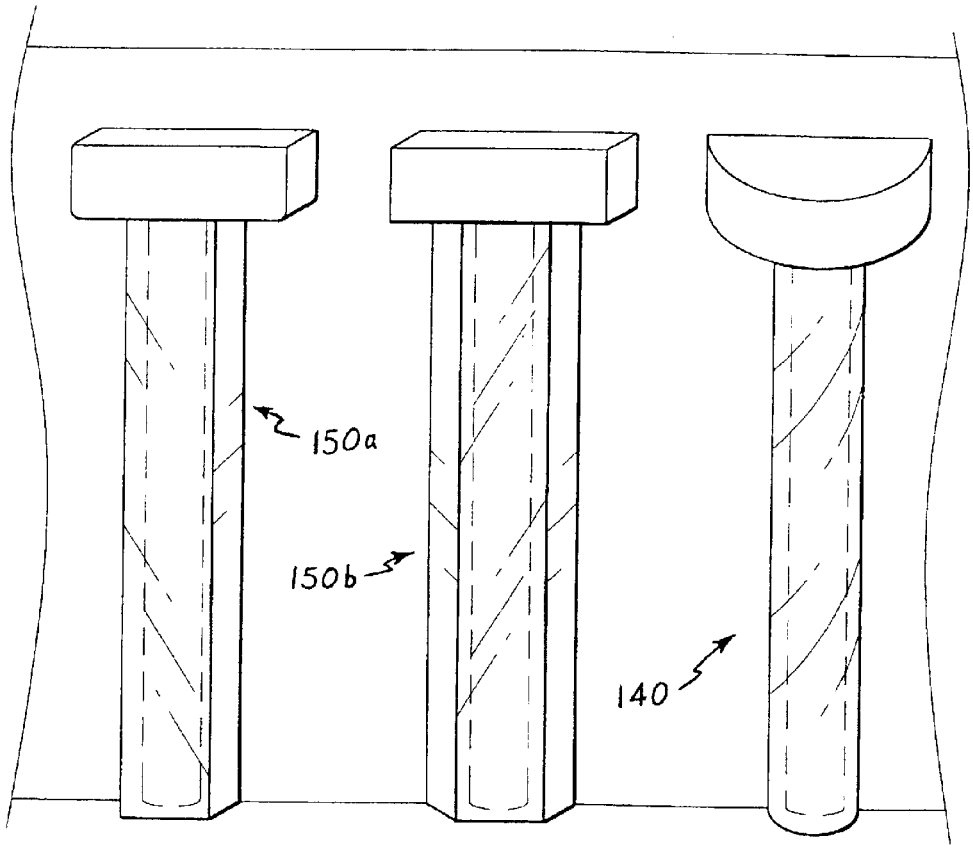

FIG. 15 is a perspective view showing the twelfth embodiment and thirteenth and fourteenth embodiments installed as wall sconces, with the embodiments of FIG. 15 each having a different shape.

Figure 16:
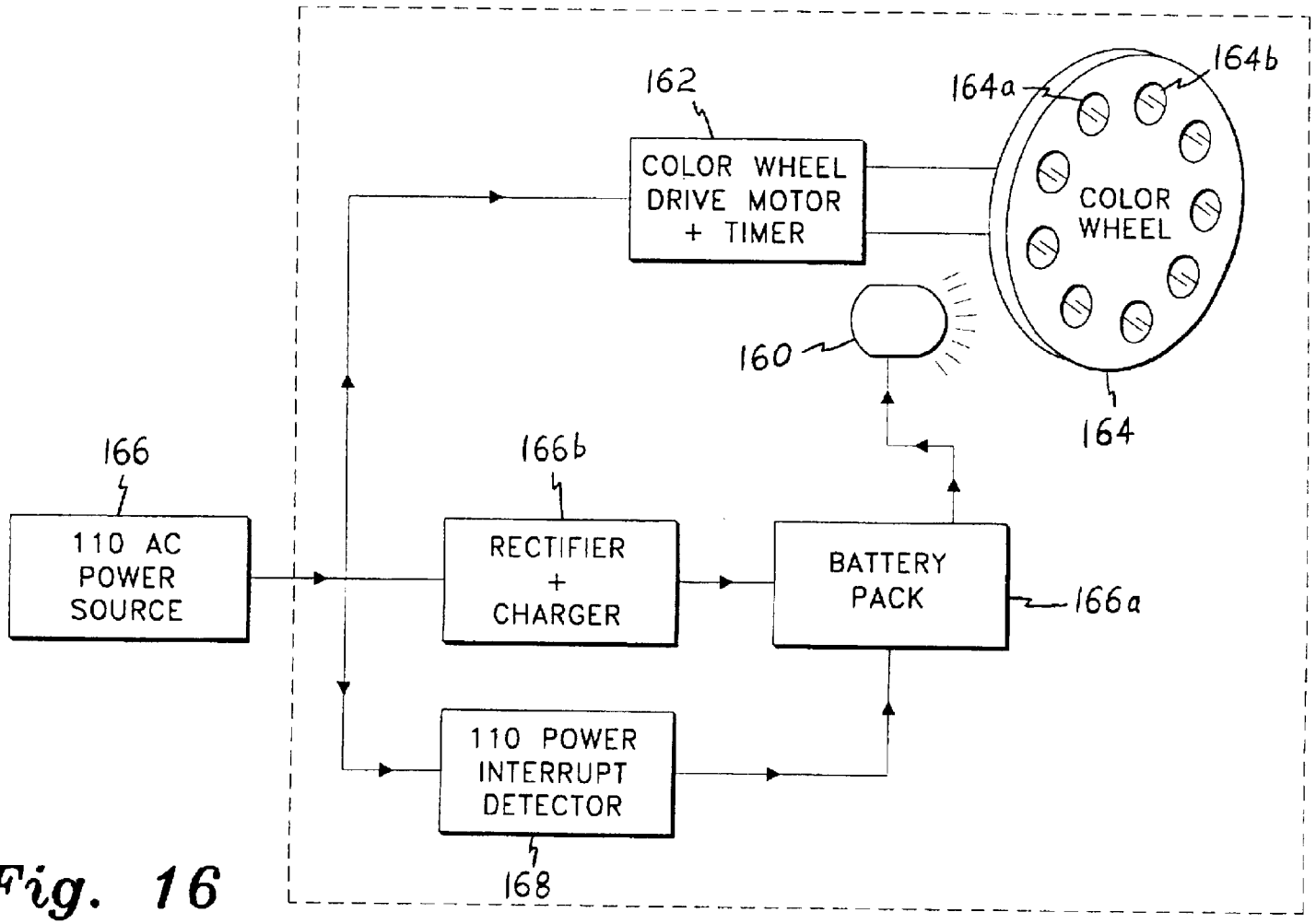

FIG. 16 is a schematic diagram illustrating the lighting system which may be used with any of the embodiments of the present invention, as well as means for altering the color of the lighting.

Similar reference characters denote corresponding features consistently throughout the attached drawings.

DETAILED DESCRIPTION OF THE PREFERRED EMBODIMENTS

The present invention comprises a series of embodiments of an illuminated translucent device, wherein an elongate, translucent or transparent length of material is illuminated from opposite ends thereof, and/or at one or more intermediate points therealong. A channel or passage is provided through or along the translucent member, for the installation of wiring therein for the lighting means. The channel or passage is preferably concealed with a decorative finish or the like.

Figure 1:
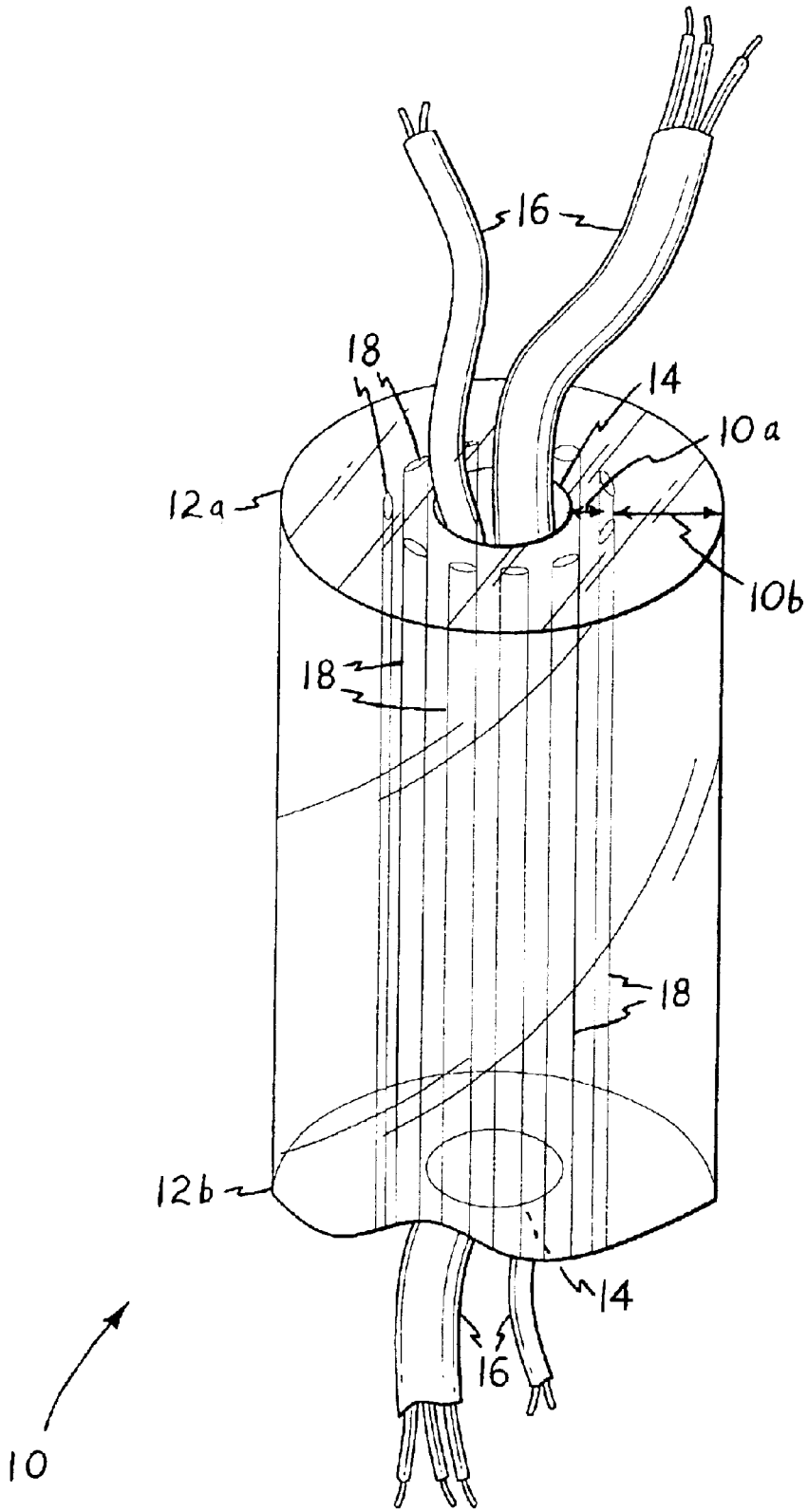
FIG. 1 is a perspective view of a first embodiment of the present invention, comprising an elongate translucent member having a concentric passage therethrough and a series of opaque bands disposed concentrically about the passage to conceal the passage.

FIG. 1 of the drawings illustrates a first embodiment of the present invention, comprising a single rigid, elongate, translucent length of material 10 having opposite first and second ends 12*a* and 12*b* (the second end 12*b* is shown truncated in FIG. 1, to indicate the indefinite length of the translucent body 10). A channel or passage 14 is formed concentrically through the device 10, for installing at least one electrical conductor(s) 16 therethrough. The wiring 16 extends from end to end through the translucent body 10, and supplies electrical energy for various lighting elements, disclosed in other drawings and discussed in detail further below.

In the embodiment of FIG. 1, a series of opaque, externally reflective stripes of material 18 are disposed about the central passage 14, thereby serving to conceal the passage 14 and any wiring 16 or other elements installed therein. The magnification provided by the external curvature of the substantially cylindrical translucent body 10, serves to magnify the reflective stripes 18 to enhance their coverage of the wiring passage 14, and any wiring 16 or other elements, installed within the passage 14. Preferably, the opaque elements 18 are disposed in a substantially cylindrical array about the central passage 14, and are spaced somewhat outwardly from the passage 14 by an inner portion 10*a* of the translucent body 10, with the translucent body 10 having an outer portion 10*b* extending generally radially outwardly beyond the opaque reflective portion 18. Lighting the device from either or both ends 12*a* and/or 12*b*, results in an attractive reflection from the elements 18, concealing the passage 14 and wiring 16 therein.

Figure 2:
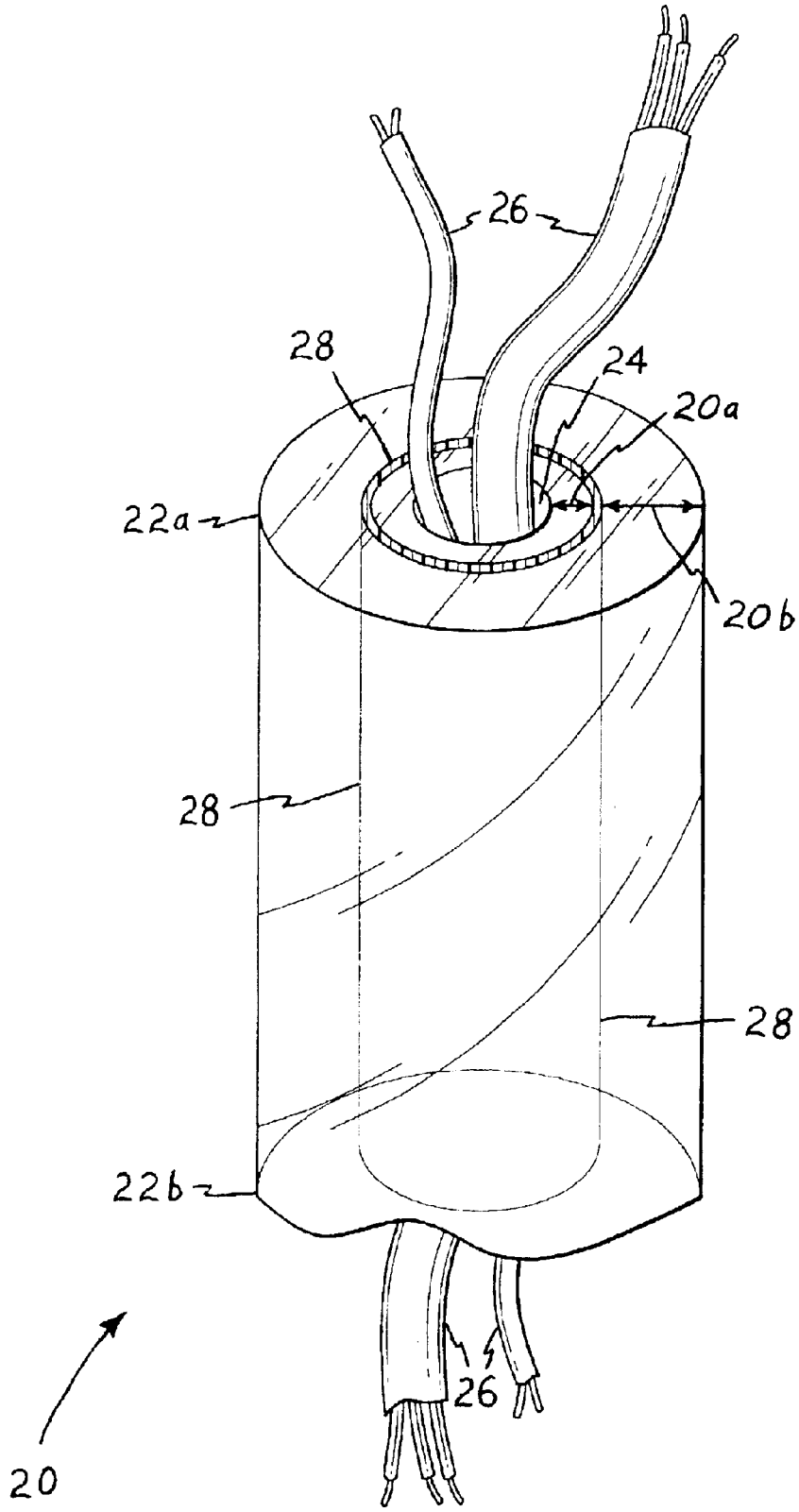
FIG. 2 is a perspective view of a second embodiment of the present invention, similar to the embodiment of FIG. 1 but having a continuous opaque cylinder disposed about the central passage.

FIG. 2 illustrates a second embodiment of the present invention, closely resembling the embodiment of FIG. 1. The only difference between the embodiments of FIG. 1 and FIG. 2, is in the configuration of the element or elements which serve to conceal the wiring passage and wiring therein, in each of the devices. The embodiment of FIG. 2 comprises a single rigid, elongate, translucent length of material 20 (translucent or transparent acrylic plastic, etc.) with opposite first and second ends 22*a* and 22*b* (with the second end 22*b* shown truncated in FIG. 2). An electrical wiring or conductor channel or passage 24 is formed concentrically through the device 20, with wiring 26 extending from end to end through the translucent body 20.

In the embodiment of FIG. 2, a single, substantially cylindrical, opaque element or sleeve 28 is disposed about the central passage 24, thereby completely concealing the central passage 24 and any wiring 26 installed therein. The cylindrically configured opaque sleeve 28 is preferably reflective at least upon its outwardly facing surface, and is spaced somewhat outwardly from the passage 24 by an inner portion 20*a* of the translucent body 20, with the translucent body 20 having an outer portion 20*b* extending generally radially outwardly beyond the opaque reflective portion 28. As in the case of the opaque elements 18 of the translucent device 10 of FIG. 1, the opaque sleeve 28 of the device 20 of FIG. 2 may be formed of an opaque, reflective plastic material which is extruded into the body of the device at the time of manufacture, or otherwise installed integrally with the body of the device.

FIG. 3 provides a side elevation in section, showing a means for treating the plastic material of the body of the present translucent device in order to render it substantially opaque. The embodiment of FIG. 3 includes a single rigid, elongate, translucent length of material 30 formed of acrylic plastic or other chemically related material, with opposite first and second ends 32*a* and 32*b* (shown truncated in FIG. 3). An electrical wiring or conductor channel or passage 34 is formed concentrically through the device 30, for the installation of wiring (not shown in FIG. 3, but essentially the same as that illustrated in other drawing Figs.) extending from end to end through the translucent body 30.

Rather than including a separate opaque structure within the body of the device 30, the internal passage 34 of the acrylic plastic material is chemically treated with a solvent 36 (e.g., acetone, etc.) or other suitable substance which penetrates the material and causes it to take on a milky white translucent or opaque appearance, and/or produces a myriad of minute cracks and crazing in the material (depending upon the specific chemical relationship), as indicated by the pattern 30*a* illustrated in FIG. 3 in the body 30 of the device. This chemical treatment serves to conceal the internal passage 34, and thus conceals any wiring or other structure installed within the passage 34. As this chemical treatment may weaken the structure of the device 30, an outer translucent or transparent sleeve of material 38 is preferably installed about the body 30, for structural strength and for transmitting light therealong as well.

FIG. 4 illustrates yet another embodiment of the present invention, differing in the means used to provide the opaque structure for concealing the concentric internal passage therein. In FIG. 4, the single rigid, elongate, translucent length of material 40 (translucent or transparent acrylic plastic, etc.) has opposite first and second ends 42*a* and 42*b* (with the second end 42*b* shown truncated in FIG. 4). An electrical wiring or conductor channel or passage 44 is formed concentrically through the device 40, with wiring (not shown in FIG. 4, but essentially the same as that illustrated in other drawing Figs.) extending from end to end through the translucent body 40.

In the embodiment of FIG. 4, a single, substantially cylindrical tubular, opaque structural element or sleeve 48 is installed within the central passage 44, thereby completely concealing the central passage 44 and any wiring installed therein. The cylindrically configured opaque tube 48 is preferably reflective at least upon its outwardly facing surface, in order to reflect light outwardly which is transmitted through the translucent body of the device 40. The structural tube or sleeve 48 not only serves to conceal the passage 44 and any structure installed therein, but also serves as a structural member for supporting the translucent column 40, as well as any other structure which might be supported thereby (e.g., where the column 40 is used to support a ceiling fan, floor lamp, or other device suspended from or supported by a column).

FIG. 5 of the drawings illustrates still another embodiment of the present invention, comprising a single rigid, elongate, translucent length of material 50 (translucent or transparent acrylic plastic, etc.) with opposite first and second ends 52*a* and 52*b* (with the second end 52*b* shown truncated in FIG. 5). An electrical wiring or conductor channel or passage 54 is formed concentrically through the device 50, as in the devices of FIGS. 1 through 4. However, rather than installing a hollow tubular support member through the wiring passage, as in the case of the embodiment of FIG. 4, a solid structural support rod 58 is inserted through the passage 54, with the wiring 56 extending along the support rod 58 (e.g., spiraled around the rod 58, etc.).

Depending upon the pattern used for installing the wiring 56 about the rod 58, a decorative pattern may be achieved by this means alone. However, the inner wall of the passage 54 may be coated or otherwise rendered opaque (this is not illustrated in FIG. 5) in the manner described further above for the devices illustrated in FIGS. 1 through 4 in order to conceal the support rod 58 and wiring 56 contained therein, if so desired. The solid structural support rod 58 serves essentially the same purpose as that provided by the hollow tube 48 of the assembly of FIG. 4, i.e., strengthening and supporting the translucent body 50 and any other structure supported thereby or therefrom, as in the examples cited above in the discussion of the assembly 40 of FIG. 4 and illustrated in FIGS. 9 and 10, which devices are discussed further below.

FIG. 6 illustrates a further embodiment of the present invention, in which the elongate translucent body is surrounded by an opaque structural sleeve, with the sleeve including one or more (preferably a plurality of) light passages therethrough. The device of FIG. 6 comprises a single rigid, elongate, translucent length of material 60 (translucent or transparent acrylic plastic, etc.) with opposite first and second ends 62*a* and 62*b* (with the second end 62*b* shown truncated in FIG. 6). An electrical wiring or conductor channel or passage 64 is formed concentrically through the device 60, as in the devices of FIGS. 1 through 5.

However, rather than installing an opaque structure within or surrounding the passage 64 to conceal components installed therein, an external structural tube 68 is secured about the translucent length of material 60. The tube 68 is preferably formed of a durable metal, to provide the desired structural strength for the assembly. As such materials are of course completely opaque, the present invention includes at least one (and preferably a plurality of) light passage(s) 68*a* formed (punched, etc.) through the wall 68*b* of the tube 68. This assembly does not require any internal opaque structure surrounding or coating the internal passage 64 to conceal the passage 64 and any wiring or other component(s) installed therein. Rather, the external structural tube or pipe 68 serves this function, as well as providing the desired structural strength for use in guard rails and bannisters, vehicle structural members and guards, etc., while still allowing illumination to pass from the device by means of the light passage(s) 68*a*.

As the assembly of FIG. 6 provides sufficient structural strength for the device to be used for relatively long runs or spans, some form of intermediate connector may be required to link a series of such components together, as well as to provide additional lighting energy at periodic points along the length of the rail or other structure. FIG. 7 illustrates one such means developed for linking a series of the assemblies of FIG. 6, together in and end-to-end array. In FIG. 7, a first assembly 60*a* and a second assembly 60*b* are illustrated in a separated relationship from one another. The first end 62*a* of the first assembly 60*a* faces toward the second end 62*b* of the second assembly 60*b*. Electrical wiring, respectively 66*a* for the first assembly 60*a* and 66*b* for the second assembly 60*b*, is installed through the respective central passages 64*a* and 64*b* of the two assemblies.

Each assembly 60*a* and 60*b* has a surrounding structural tube or pipe, respectively 69 for the first assembly 60*a* and 68 (identical to the structural tube or pipe 68 of FIG. 6) for the second assembly 60*b*. Each structural tube 68 and 69 includes a series of light passages formed therethrough, respectively 69*a* for the first structural tube 69 and 68*a* for the second tube 68.

A central coupling or connector sleeve 70 has an internal diameter dimensioned to fit closely about the exteriors of the two metal structural tubes 68 and 69, to join them together. Conventional techniques may be used to secure the two structural tubes 68 and 69 and their associated assemblies 60*b* and 60*a*, to the coupling sleeve 70, e.g. bolts, rivets, welding, etc., as desired.

The coupling 70 includes appropriate electrical wiring and connection means therein, to mate with the electrical wiring 66*a* and 66*b* of the two lengths 60*a* and 60*b*. For example, the first end 62*a* of the first length 60*a* may have a male connector plug 67*a* extending from the wiring 66*a*, with the mating end of the coupling 70 having a mating female connector plug 77*a* therein. In a similar manner, the second end 62*b* of the second length 60*b*, may be provided with a female connector 67*b*, with the corresponding end of the coupling 70 having a mating male connector plug 77*b* therein. This configuration enables the two lengths 60*a* and 60*b* to be joined directly end-to-end, if so desired, or to be connected together using the coupling 70.

The coupling 70 provides another advantage, in that it also contains lighting to illuminate the corresponding ends of the two lengths 60*a* and 60*b*. The coupling 70 contains a series of LED lights therein, respectively LEDs 76*a* and 76*b* in the opposite ends of the coupling 70. These LEDs 76*a* and 76*b* are oriented or directed oppositely, toward the respective ends 62*a* and 62*b* of the lengths of translucent material 60*a* and 60*b*, and illuminate those translucent components from within. Electrical power for the LEDs 76*a* and 76*b* is provided by the respective electrical conductors 66*a* and 66*b* which connect to the respective plugs 77*a* and 77*b*, to provide illumination at each end of each translucent length 60*a* and 60*b*. While no electrical connection is shown between the two LED sets 76*a* and 76*b* in the coupling 70, continuous electrical connection may be provided across the coupling 70, if so desired.

FIG. 7 also illustrates an illuminated end cap 71, which may be installed upon a terminating end of one of the translucent lengths 60*a* or 60*b*, at the end of a run of such assemblies. The end cap 71 includes an appropriately configured electrical connector or plug, e.g., the female plug 67*c* illustrated for connecting with a mating male plug in the end of one of the translucent lengths 60*a*, 60*b*, etc. An end cap with a male connector plug may be provided for the opposite end or configuration of the assembly. The end cap 71 preferably includes one or more LED lights 76*c* therein, which receive electrical power from the connector plug 67*c* of the end cap 71 and are oriented toward the mating end of the translucent length to which the end cap 71 is secured. In this manner, an end of an elongate translucent member having an end cap 71 installed thereon, may be illuminated just as other lengths are illuminated at each end by their couplings 70.

FIG. 8 provides an illustration of yet another embodiment of the present invention, comprising an assembly 80 of mutually concentric translucent tubular lengths of material. An innermost tube 80*a* contains a concentric wiring passage 84 therethrough, with electrical wiring conductors 86 extending through the passage 84 from the first end 82*a* to the second end 82*b* of the assembly 80. An intermediate tube 80*b* surrounds the innermost tube 80*a*, with an outermost tube 80*c* surrounding the intermediate tube 80*b*. It will be seen that more concentric translucent tubes may be assembled together, or as few as two tubes may be used, as desired.

The series of tubular lengths 80*a* through 80*c* are free to rotate relative to one another, and are preferably electrically powered by a conventional electric motor and gearing to rotate the adjacent tubes in opposite directions and/or at different speeds from one another. The outer surfaces of the various tubes include various light emitting or diffusing patterns thereon, respectively 88*a* through 88*c* for the three tubes 80*a* through 80*c*. These illumination patterns 88*a* through 88*c* may comprise decals, printed forms, etched or embossed patterns, etc., as desired. As the three tubes 80*a* through 80*c* rotate, the patterns 88*a* through 88*c* also rotate relative to one another, to provide an attractive display. Alternatively, one or more of the tubes 80*a* through 80*c* may be coated with an opaque covering, with the patterns 88*a* through 88*c* formed as light passages through the opaque coverings, if desired.

FIG. 9 illustrates an elevation view in section of an exemplary application for the present invention, particularly any of the embodiments of FIGS. 1 through 5, although other embodiments of the present invention may be utilized in the structure of FIG. 9 as well. FIG. 9 illustrates a floor lamp 90, having a rigid, elongate, translucent length of material 90*a* for the column thereof, with an upper or first end 92*a* and an opposite lower or second end 92*b*. The column 90*a* includes a concentric passage 94 formed therein, which serves as a conduit for the electrical wiring 96 which extends upwardly to the lighting means contained in the upper end 92*a* of the device. The column is preferably lined with an opaque coating (not shown), to conceal the passage 94 therein.

Each end 92*a* and 92*b* of the column 90*a* may be provided with one or more LED lights adjacent thereto and oriented or directed to transmit their illumination axially into the translucent body of the column 90*a*. In the example of FIG. 9, a series of first or upper LEDs 98*a* is provided at the upper or first end 92*a* of the column 90*a*, with a series of second or lower LEDs 98*b* installed at the lower or second end 92*b* of the column 90*a*. A separate switch 99 may be provided to control power to the LEDs 98*a* and 98*b*, through dedicated wiring 96*a* between the switch 99 and the LEDs 98*a* and 98*b*. The LED switch 99 in turn receives its power from the conventional lamp switch, and may be wired in series or parallel with that switch to control the LEDs from the lamp switch or independently of the lamp switch, as desired.

FIG. 10 illustrates another embodiment of the present invention, wherein a ceiling fan 100 is secured by means of a support shaft, rod, or column 100*a* formed of a length of translucent material in accordance with the present invention. The fan support shaft 100*a* has a first or ceiling attachment end 102*a*, and an opposite second or fan attachment end 102*b*. The basic structure of the device closely resembles that of the floor lamp support column 90*a* illustrated in cross section in FIG. 9 of the drawings, with the support shaft 100*a* having a concentric passage therethrough for electrical conductors and at least one LED disposed at at least one of the two ends 102*a* and/or 102*b*, to illuminate the translucent column 100*a*, similarly to the manner described for the floor lamp support column 90*a* of FIG. 9.

FIG. 11 of the drawings illustrates yet another embodiment of the present invention, wherein the channel containing the electrical conductor(s) is radially offset from the center of the elongate length of material. In FIG. 11, the elongate translucent body of material 110 has opposite first and second ends, respectively 112*a* and 112*b* (with the second end 112*b* shown truncated in FIG. 11). An electrical conductor or wiring passage or channel 114 is formed along the outer surface of the body 110 and extends between each of the two ends 112*a* and 112*b*, with the electrical conductor (s) or wiring 116 placed within the channel or passage 114. The wiring channel or passage 114 is actually formed in a length of opaque reflective material 118, which is in turn applied along the outer surface of the translucent body 110. This placement of the wiring channel or passage 114 within the opaque portion 118 of the assembly 110, serves to conceal the wiring channel or passage 114 from any observers who may view the assembly 110.

The assembly 110 is illuminated in the manner described further above and illustrated in detail for the floor lamp support column 90*a* of FIG. 9, i.e., using one or more lights (LEDs, etc.) disposed at one or both end(s) 102*a*, 102*b* of the column 110, and oriented or directed to transmit their light into the translucent material of the column or body 110. The opaque material 118 disposed along one side of the device, serves to reflect the light outwardly through the translucent material, and also conceals the wiring within the channel or passage 114 from view.

FIG. 12 illustrates a variation upon the illuminated translucent device of FIG. 11, wherein an additional component is provided to secure the wiring within the channel and also to provide additional reflectivity for the assembly. The embodiment of FIG. 12 includes an elongate, translucent body of material 120 with opposite first and second ends, respectively 122*a* and 122*b* (with the second end 122*b* shown truncated in FIG. 12). An electrical conductor or wiring passage or channel 124 is formed along the outer surface of the body 120 and extends between each of the two ends 122*a* and 122*b*, with the electrical conductor(s) or wiring 126 placed within the channel or passage 124. The wiring channel or passage 124 is actually formed in a length of opaque reflective material 128, which is in turn applied along the outer surface of the translucent body 120.

To this point, the structure of the device 120 of FIG. 12 is essentially identical to the structure of the device 110 of FIG. 11, described further above. However, the assembly 120 of FIG. 12 includes an additional reflective element 129, comprising a semirigid, semicylindrical reflective sleeve of material (plastic, etc.) which is shaped to fit closely about the translucent assembly 110 with its opaque element 128, thereby securing the wiring 126 within the channel 124. Alternatively, the reflective element 129 may comprise a reflective (or phosphorescent, etc.) coating applied partially about the exterior of the assembly 120, with a gap or window 129*a* remaining open to allow light to escape from the assembly 120 when it is illuminated as described further above.

FIG. 13 illustrates still another embodiment of the present invention, resembling the embodiments of FIGS. 11 and 12 discussed further above. The embodiment of FIG. 13 includes an elongate, translucent body of material 130 with opposite first and second ends, respectively 132*a* and 132*b* (with the second end 132*b* shown truncated in FIG. 13). An electrical conductor or wiring passage or channel 134 is formed as a groove along the exterior of the body 130 and extends between each of the two ends 132*a* and 132*b*, with the electrical conductor(s) or wiring 136 placed within the channel or passage 134.

It will be noted that the embodiment 130 of FIG. 13 differs from the embodiments of FIGS. 11 and 12, in that the device 130 does not include an opaque portion having the wiring channel formed therein. Rather, the wiring channel or passage 134 is formed directly into the outer surface of the translucent body of material 130. However, an additional opaque reflective coating 138 (e.g., reflective or phosphorescent plastic shell, or painted or otherwise applied coating, etc.) is applied partially about the outer surface or circumference of the translucent body 130, and along and within the channel 134. This coating or shell 138 serves to conceal any wiring 136 from view through the translucent body portion 130 of the device. The opaque wiring concealing coating 138 is applied only partially about the circumference of the device 130, in order to leave a relatively wide translucent area 139 through which light is transmitted and radiated to provide the desired illumination effect.

To this point, each of the embodiments of the present translucent illuminated device as illustrated in FIGS. 1 through 13, have been illustrated as having at least substantially cylindrical configurations, including their opaque reflective elements. However, it will be seen that the present illuminated translucent devices need not be formed to have solely a cylindrical shape, but may be formed to have any of a number of other shapes as desired. FIG. 14 of the drawings illustrates one such alternative embodiment, comprising an elongate, translucent body of material 140 with opposite first and second ends, respectively 142*a* and 142*b* (with the second end 142*b* shown truncated in FIG. 14). An electrical conductor or wiring passage or channel 144 is formed as a groove along the exterior of the body 140 and extends between each of the two ends 142*a* and 142*b*, with the electrical conductor(s) or wiring 146 placed within the channel or groove 144.

However, rather than forming the translucent body portion in a cylindrical configuration, the translucent body 140 of the embodiment of FIG. 14 has a semicylindrical configuration. The wiring channel, passage or groove 144 is formed along the flat rearward surface 140*a* of the body 140, with the opaque reflective coating material 148 being applied to the flat rearward surface area 140*a*, and along and within the wiring channel 144 formed therein. The cylindrical front portion 140*b* of the device 140, provides a relatively wide translucent area 149 through which light is transmitted and radiated after being reflected outwardly from the coating 148, to provide the desired illumination effect.

FIG. 15 illustrates a series of variations upon the device 140 illustrated in FIG. 14, showing their installation upon a wall W or other similar structure. The illuminated elongate element to the far right side of FIG. 15 comprises a wall installation of the embodiment 140 of FIG. 14, with the left and center embodiments, respectively 150*a* and 150*b*, having essentially the same structure as that described for the embodiment 140 of FIG. 14 and to the right side of FIG. 15. The embodiments 150*a* and 150*b* differ from the embodiment 140 only in the external shape of their translucent elements, with the left side embodiment 150*a* of FIG. 15 having a generally rectangular configuration, while the center embodiment 150*b* has a generally trapezoidal configuration. It will be seen that such wall mounted configurations may have a cross section comprising any practicable geometric shape, so long as each embodiment has at least one flat side (e.g., the flat surface 140*a* of the semicylindrical embodiment 140, shown in FIG. 14) to which the opaque reflective coating may be applied and which may be secured against the wall structure.

While no particular colors of lighting or specific means for changing the lighting color have been described to this point, it will be seen that means may be provided for applying different lighting colors to any of the embodiments of the present invention, and/or means for changing those colors periodically as desired. FIG. 16 provides a block diagram showing the various components which may be used for such light color changing apparatus, and their general relationship.

The same electrical power used to illuminate the LEDs (e.g., the single LED 160 illustrated in FIG. 16) or other light source(s) used to illuminate the present devices, may also be used to power a conventional drive motor 162 (e.g., stepper motor, etc., as desired), which in turn rotates a color wheel 164 having a series of differently colored lenses 164*a*, 164*b*, etc. A conventional timer may be incorporated with the motor 162, and/or manually activated switch means may be provided to activate the motor 162 and rotate the color wheel 164 as desired. Alternatively, the color wheel 164 may be rotated manually, if so desired.

Any of the embodiments of the present invention may receive their electrical power from a conventional 110–115 volt AC power source, e.g., conventional wall outlet, etc., as indicated generally by the 110 AC power source 166 of FIG. 16. However, the present system may also be used as a source of backup or emergency lighting, if properly configured. Accordingly, FIG. 16 also provides for a battery powered electrical supply 166*a*, which has an electrical charge maintained by a conventional rectifier and charger system 166*b*. A conventional power interrupt detector 168 senses any loss of electrical power from the 110 volt power supply 166, and automatically switches electrical power for at least the LED(s) 160 (and also for the color wheel drive motor apparatus 162, depending upon how the system is wired) to operate the system in the event of a power failure. Under such circumstances, the color wheel drive motor 162 may be set to rotate the color wheel 164 to some predetermined color (e.g., red, etc.), if so desired.

In conclusion, the present illuminated translucent devices in their various embodiments, provide for an extremely wide range of different devices and/or applications of the present invention, for illuminating innumerable different types of devices. Certain embodiments, e.g., the generally cylindrical variations having a central concealed wiring passage, are well suited for use as omnidirectionally radiating rods, shafts, columns, etc., for use in supporting floor lamps, ceiling fans, and other such devices having a single, elongate support column or shaft. Smaller versions may be used as radially emitting flashlights, illumination for toolboxes, and other utility lights as desired. The concealed internal wiring channel also provides for the installation of a structural element therein, for additional strength where needed.

Another variation upon the present invention comprises the enclosure of the translucent element with a generally opaque structural member, with the external structural member having one or more (preferably a plurality of) light passages formed therethrough. The external structural member enables the present invention to be used where additional structural strength is required, e.g., for bridge railings, guard rails, etc. The provision of couplings or connectors containing additional lighting means therein, enables a series of such elongate elements to be linked together end-to-end, with the connectors providing the required light amplification to provide a continuously illuminated structure, by means of the light passages formed through the walls of the external tubular structural members.

Other variations include a flat mounting surface, permitting the illumination device to be mounted or affixed to a wall or other flat structure, with the light radiating only from the translucent area(s) opposite the opaque mounting surface of the device. Such units are well suited for use as wall sconces, etc., and may be used as surface mounted devices for use in the lids of toolboxes, upon vehicle body structures, etc., as desired.

Any of the above described embodiments may incorporate additional circuitry enabling the colors of the lighting to be varied or changed, as desired. Such additional circuitry may incorporate an emergency electrical power supply, with the device being well suited for use as an emergency lighting system when so equipped. In addition, further circuitry may be incorporated with any of the embodiments of the present invention to cause the lights to flash or vary in intensity in accordance with audio input, if so desired. Such variable lighting intensity according to audio input may be applied to wall sconces and other decorative illuminating devices for use in night clubs and the like, or wherever such a display might be desired. Such a system is also applicable to lighting applied to a motor vehicle, as well. Thus, the present invention in any of its embodiments provides a novel and attractive means for illuminating a wide variety of different devices and areas for decorative or other purposes, as desired.

It is to be understood that the present invention is not limited to the embodiments described above, but encompasses any and all embodiments within the scope of the following claims.

We claim:

1. An illuminated translucent device, comprising:

at least one rigid, elongate, translucent length of material having a first end, a second end opposite said first end, and having a channel extending from said first end to said second end;

at least one length of electrical conductor disposed within said channel, and extending from said first end to said second end of said at least one translucent length of material;

at least one substantially opaque element surrounding and enclosing said channel, and concealing said channel from view through said at least one translucent length of material; and at least one light disposed at each said end of said at least one translucent length of material, directionally oriented toward each respective said end of said at least one translucent length of material for illuminating said at least one translucent length of material from within.

2. The illuminated translucent device according to claim 1, wherein said channel comprises a single concentric passage formed within said at least one translucent length of material.

3. The illuminated translucent device according to claim 2, further including a solid structural support rod installed within aid concentric passage.

4. The illuminated translucent device according to claim 2, wherein:

said at least one substantially opaque element comprises a plurality of opaque, externally reflective stripes disposed concentrically about said concentric passage in a cylindrical array; and at least a portion of said at least one translucent length of material extends radially outwardly beyond and surrounds said at least one substantially opaque element.

5. The illuminated translucent device according to claim 2, wherein:

at least the portion of said at least one translucent length of material surrounding said concentric passage is chemically treated to form a substantially opaque area therein; and a translucent structural sleeve is disposed about said at least one translucent length of material.

6. The illuminated translucent device according to claim 2, wherein:

said at least one substantially opaque element comprises an opaque, unbroken cylindrical sleeve disposed concentrically about said concentric passage; and at least a portion of said at least one translucent length of material is disposed radially outwardly beyond and surrounds said cylindrical sleeve.

7. The illuminated translucent device according to claim 6, wherein said cylindrical sleeve comprises a tubular structural member.

8. The illuminated translucent device according to claim 2, wherein:

said at least one substantially opaque element comprises at least one structural tube disposed externally about said at least one translucent length of material; and said at least one structural tube further includes a wall having at least one light passage formed therethrough.

9. The illuminated translucent device according to claim 8, further including:

at least one connector sleeve fitting over and joining said at least one structural tube of said at least a first and a second said translucent length of material together in an end-to-end array; and at least a first light and a second light disposed within said connector sleeve, with said first light and said second light being directionally oriented oppositely to one another and directing light produced therefrom respectively into said first and said second translucent length of material.

10. The illuminated translucent device according to claim 8, further including:

at least one end cap fitting over said structural tube of said at least one translucent length of material, and covering at least one said end of said at least one translucent length of material; and at least one light disposed within said end cap, with said at least one light being directionally oriented toward and directing light produced therefrom respectively into said at least one translucent length of material.

11. The illuminated translucent device according to claim 2, wherein said at least one translucent length of material comprises a plurality of concentric cylindrical lengths of material in a rotational relationship with one another.

12. The illuminated translucent device according to claim 11, further including at least one illumination pattern disposed upon each of said concentric cylindrical lengths of material and providing a moving light display when said concentric cylindrical lengths of material are rotated relative to one another.

13. The illuminated translucent device according to claim 1, wherein:

said at least one substantially opaque element surrounding and enclosing said channel, and concealing said channel from view through said at least one translucent length of material, comprises an elongate segment of opaque material disposed upon said at least one translucent length of material, and extending from said first end to said second end thereof; and said channel comprises a groove formed externally along said elongate segment of opaque material.

14. The illuminated translucent device according to claim 13, further including a semicylindrical reflective sleeve disposed about said opaque portion and securing said at least one length of electrical conductor within said groove.

15. The illuminated translucent device according to claim 1, wherein:

said channel comprises an external groove formed along said at least one translucent length of material, and extending from said first end to said second end thereof; and said at least one substantially opaque element surrounding and enclosing said channel, and concealing said channel from view through said at least one translucent length of material, comprises an opaque, reflective coating disposed over said translucent length of material and along and within said channel.

16. The illuminated translucent device according to claim 1, wherein said at least one translucent length of material has at least a generally cylindrical configuration.

17. The illuminated translucent device according to claim 1, wherein said at least one translucent length of material has a cross section comprising a geometric shape having at least one flat side.

18. The illuminated translucent device according to claim 1, further including light color changing apparatus.

19. The illuminated translucent device according to claim 1, further including an electrical storage power supply.

20. The illuminated translucent device according to claim 1, wherein said at least one rigid, elongate, translucent length of material is selected from the lengths of material consisting of floor lamp columns, ceiling fan support shafts, guard rails, bannisters, and vehicle structural guards.

* * * * *